US006693374B2

(12) United States Patent
Tho et al.

(10) Patent No.: US 6,693,374 B2
(45) Date of Patent: Feb. 17, 2004

(54) FLAT CRT PANEL

(75) Inventors: Gi Hoon Tho, Kyongsangbuk-do (KR); Sung Han Jung, Kumi (JP)

(73) Assignee: LG Philips Displays Korea Co., Ltd., Kyongsangbuk-do (KR)

( * ) Notice: Subject to any disclaimer, the term of this patent is extended or adjusted under 35 U.S.C. 154(b) by 48 days.

(21) Appl. No.: 10/175,045

(22) Filed: Jun. 20, 2002

(65) Prior Publication Data

US 2003/0052591 A1 Mar. 20, 2003

(30) Foreign Application Priority Data

Sep. 11, 2001 (KR) ..... 2001-0055685

(51) Int. Cl.[7] ..... H01J 29/18; H01J 29/07
(52) U.S. Cl. ..... 313/477; 313/408; 313/461
(58) Field of Search ..... 313/477, 408, 313/461, 402, 440, 403, 477 R, 463, 469

(56) References Cited

U.S. PATENT DOCUMENTS 6,337,535 B1 * 1/2002 Kim ..... 313/461
6,555,951 B2 * 4/2003 Jeoung ..... 313/408
2002/0084741 A1 * 7/2002 Baek ..... 313/461
2002/0171348 A1 * 11/2002 Lee et al. ..... 313/402
2002/0175615 A1 * 11/2002 Wang et al. ..... 313/479

FOREIGN PATENT DOCUMENTS

EP 1 152 451 A2 7/2001

* cited by examiner

*Primary Examiner*—James Clinger
*Assistant Examiner*—Chuc Tran
(74) *Attorney, Agent, or Firm*—Birch, Stewart, Kolasch & Birch, LLP

(57) ABSTRACT

Flat CRT panel including a substantially flat outside surface, and an inside surface with a certain radius of curvature, wherein the panel is formed such that (Ts/Tm)*CFT*Rz falls on a range of 28–36, where CFT denotes a center thickness, Ts denotes a diagonal effective screen edge thickness Ts, Tm denotes a maximum thickness at an interface of the skirt and the effective screen, and Rz denotes an inside radius of curvature, i.e., a value obtained by dividing a diagonal effective screen sectional radius of curvature Rd by a representative value {Rd/(1.767*a diagonal length of the effective screen)}, thereby minimizing breakage during heat treatment and reducing a production cost.

4 Claims, 5 Drawing Sheets

FLAT CRT PANEL

This application claims the benefit of the Korean Application No. P2001-55685 filed on Sep. 11, 2001, which is hereby incorporated by reference.

BACKGROUND OF THE INVENTION

1. Field of the Invention

The present invention relates to a flat cathode ray tube (CRT), and more particularly, to a flat CRT panel, which can reduce weight and breakage during heat treatment.

2. Background of the Related Art

Referring to FIG. 1, a structure of a related art color CRT will be explained.

There is a funnel 2 fitted to rear of a panel 1. There is a fluorescent film coated on an inside surface of the panel 1, and there is an electron gun 8 sealed inside of the funnel 2 for emitting an electron beam 11 that makes the fluorescent film on the panel 1 luminescent. There are a deflection yoke 9 and a magnet 10 for deflecting the electron beam 11 to a required path. There are stud pins 6 for fastening a main frame 5, to which springs 4 of a shadow mask 3 and an inner shield 7 are fitted.

The operation of the related art color CRT will be explained.

Upon application of a voltage to the electron gun 8, the electron gun 8 emits the electron beam 11. The electron beam 11 emitted thus is deflected in left or right, or up or down direction by the deflection yoke 9, and hits the fluorescent film on inside of the panel 1, according to which a picture is reproduced.

In the meantime, since an inside of the CRT is under substantially high vacuum, such that the panel 1 and the funnel 2 are under a high tension or compression, to be susceptible to implosion caused by an external impact. Consequently, in order to prevent the implosion, the panel 1 is designed to have a certain structural strength, and furthermore, there is a reinforcing band 12 strapped around an outer circumference of skirt of the panel 1, for distribution of stresses on the CRT to secure an impact resistance capability.

In the meantime, referring to FIG. 2A, most of the related art panels are not flat. That is, both an inside surface and an outside surface of the panel have certain curvatures. However, it is current trend that the CRT becomes larger and flat. That is, referring to FIG. 2B, currently a flat panel 1 having almost no curvature on the outside surface is used mostly.

Though the flat panel 1 has various advantages over the non-flat panel 1*a*, the flat panel 1 has a disadvantage in view of strength. Problems of the related art flat CRT will be explained.

First, referring to FIG. 3, the flat panel 1 has a distance from a mold match line to a seal edge line OMH greater than a non-flat panel 1*a*. That is, the flat panel 1 has an overall thickness greater than the non-flat panel 1, to cause breakage due to a high stress over a critical stress coming from a difference of heat conduction during heat treatment of the panel. That is, basically, the flat panel 1 is a structure having a limitation from breakage.

Second, the flat panel 1 is comparatively thick, and heavy, to cost high and require components, such as frame and the like, to be large sized.

SUMMARY OF THE INVENTION

Accordingly, the present invention is directed to a flat CRT panel that substantially obviates one or more of the problems due to limitations and disadvantages of the related art.

An object of the present invention is to provide a flat CRT panel which can reduce panel breakage during heat treatment (Stabi, Sealing, evacuation).

Another object of the present invention is to provide a flat CRT panel which can reduce a panel weight and cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the flat CRT panel includes a substantially flat outside surface, and an inside surface with a certain radius of curvature, wherein the panel is formed such that (Ts/Tm)*CFT*Rz falls on a range of 28–36, where CFT denotes a center thickness, Ts denotes a diagonal effective screen edge thickness Ts, Tm denotes a maximum thickness at an interface of the skirt and the effective screen, and Rz denotes an inside radius of curvature, i.e., a value obtained by dividing a diagonal effective screen sectional radius of curvature Rd by a representative value {Rd/(1.767*a diagonal length of the effective screen)}.

Preferably, the panel is formed such that the (Ts/Tm) *CFT*Rz falls on a range of 29–34.

Preferably, the Rd denotes a sectional radius of curvature on a diagonal axis, the Ts denotes an effective screen edge thickness on the diagonal axis of the panel, and Tm denotes a maximum thickness at an interface of a panel skirt and the effective screen.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
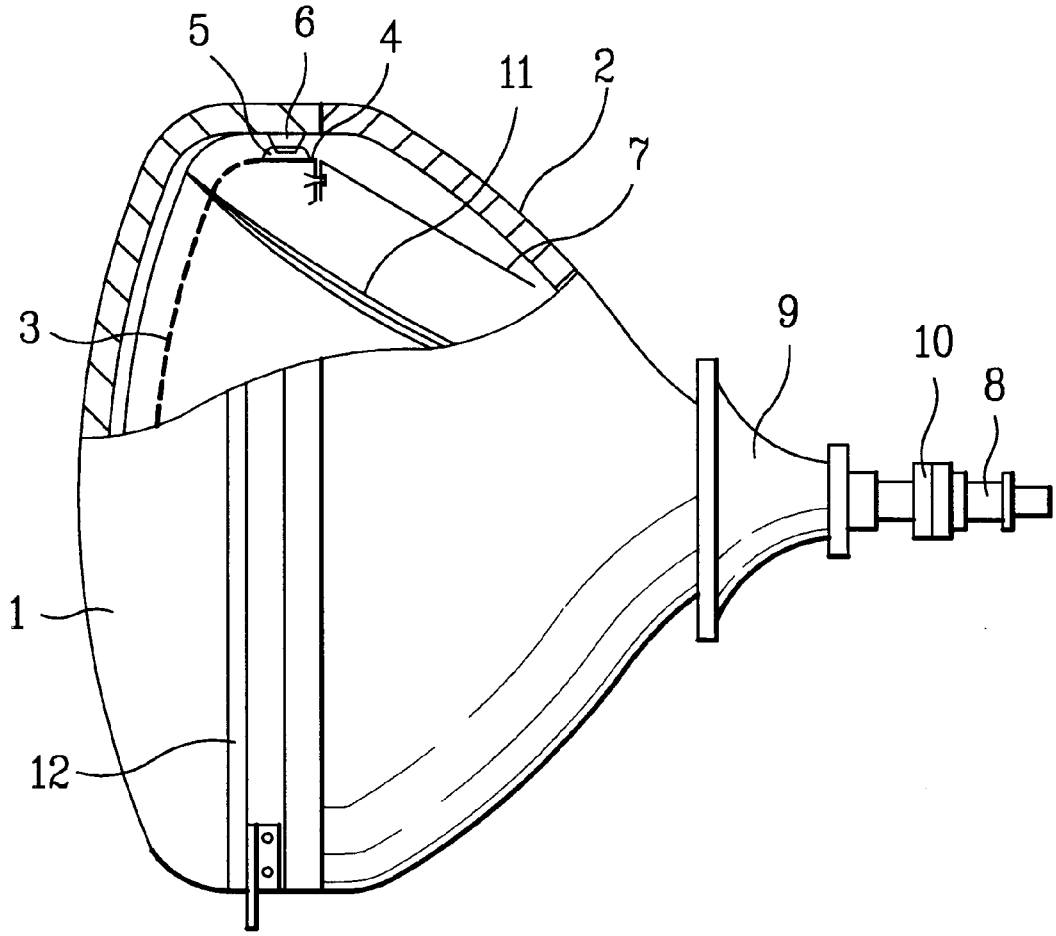
FIG. 1 Related Art
FIG. 1 illustrates a side view of a related art color CRT, with a partial cut away view.
Figure 2A:
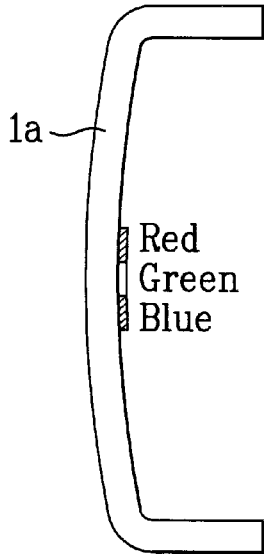
FIG. 2A illustrates a section of a non-flat panel.
Figure 2B:
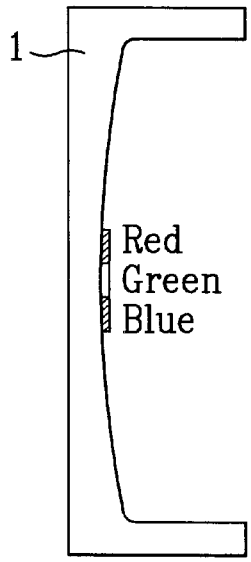
FIG. 2B illustrates a section of a flat panel.
Figure 3:
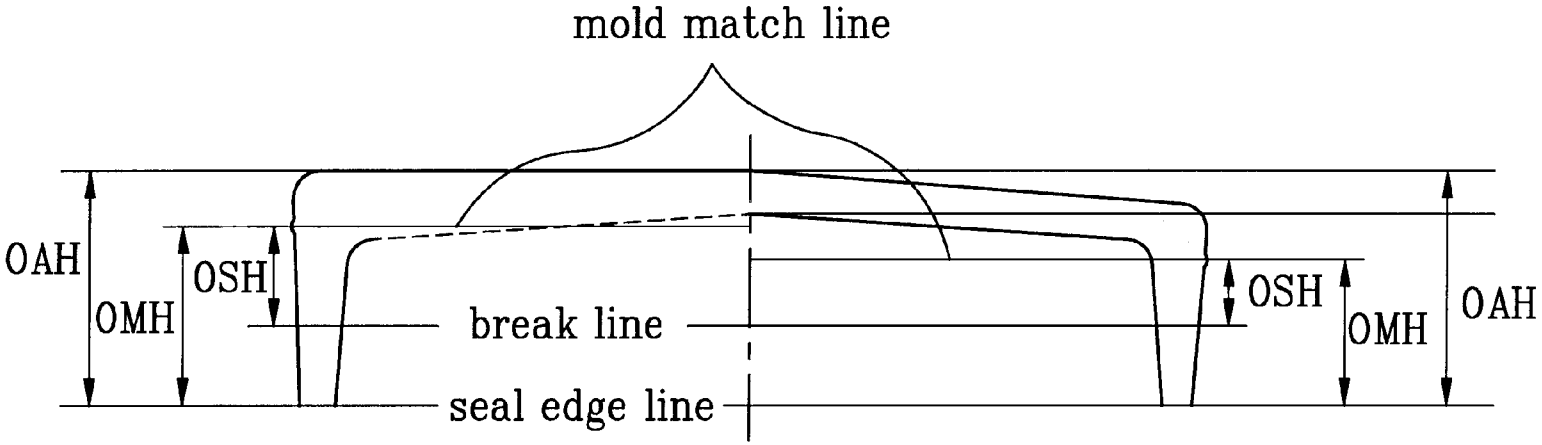
FIG. 3 illustrates half sections of a flat panel and a non-flat panel for comparison.
Figure 4:
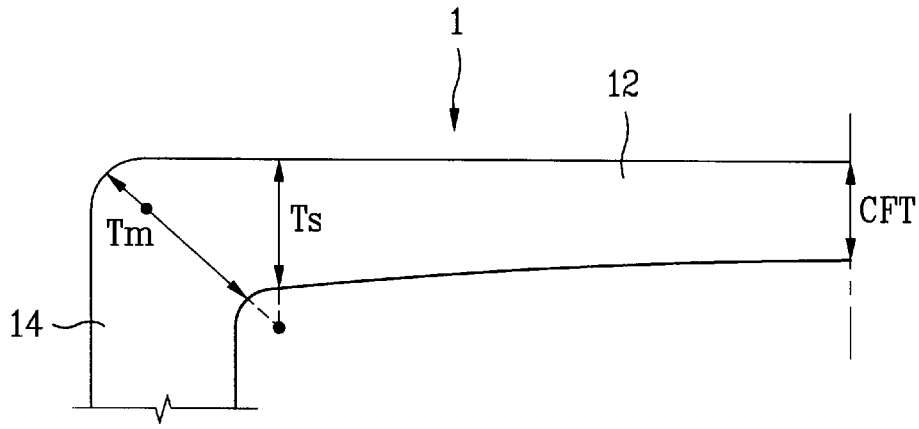
FIG. 4 illustrates a half section of a flat panel with design factors.
Figure 5:
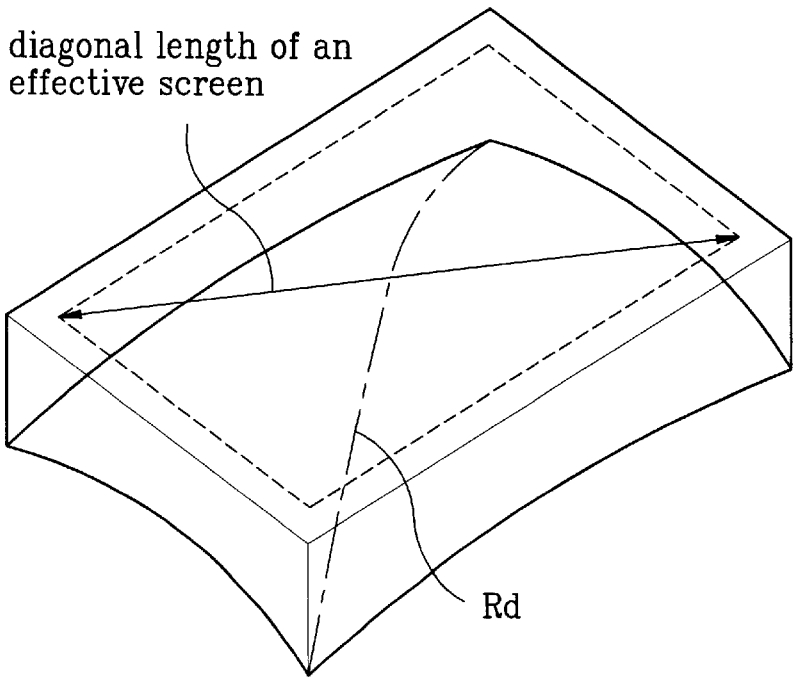
FIG. 5 illustrates a perspective view of a panel showing an effective screen size and an inside curvature of the panel; and, FIG. 6 illustrates a graph showing relations of an amount of X-ray leakage, a panel breakage ratio in heat treatment, and a vacuum stress.

Referring to FIGS. 4 and 5, the flat CRT panel includes a front part 12 and a skirt 14 extended from the front part 12 substantially perpendicular thereto. The skirt 14 of the panel 1 is welded to a funnel, and a part the panel 1 and the funnel is welded is called as a seal edge. The flat panel has an outside radius of curvature in general greater than 30,000 mm, i.e., substantially flat, and a certain inside radius of curvature.

The flat panel 1 may be represented with a center thickness CFT, a diagonal effective screen edge thickness Ts, a maximum thickness Tm at an interface of the skirt and the effective screen, an inside radius of curvature Rz, i.e., a value obtained by dividing a diagonal effective screen sectional radius of curvature Rd by a representative value {Rd/(1.767*a diagonal length of the effective screen)}. The Rz has a value ranging 2.7–3.2 depending on kinds of CRT.

Though the Ts, Tm, and Rd are represented as values measured at a diagonal section, the Ts, Tm, and Rd may be represented as values measured at a major or minor axial section.

In the meantime, it is required that the center thickness CFT is designed to take an X-ray transmittivity into account, and it is required that the Ts, Tm, and Rz are designed to take a panel weight, panel breakage during fabrication, and a panel vacuum stress into account.

The flat panel has a high ratio of breakage during heat treatment due to a great ratio (a wedge ratio) of the center thickness to the effective screen edge thickness of the panel as the outside surface of the panel is almost flat and the inside surface of the panel has a certain radius of curvature.

The inventor could have made it sure that an optimal panel design is possible by using an equation (Ts/Tm)*CFT*Rz the foregoing factors are involved therein.

Figure 6:
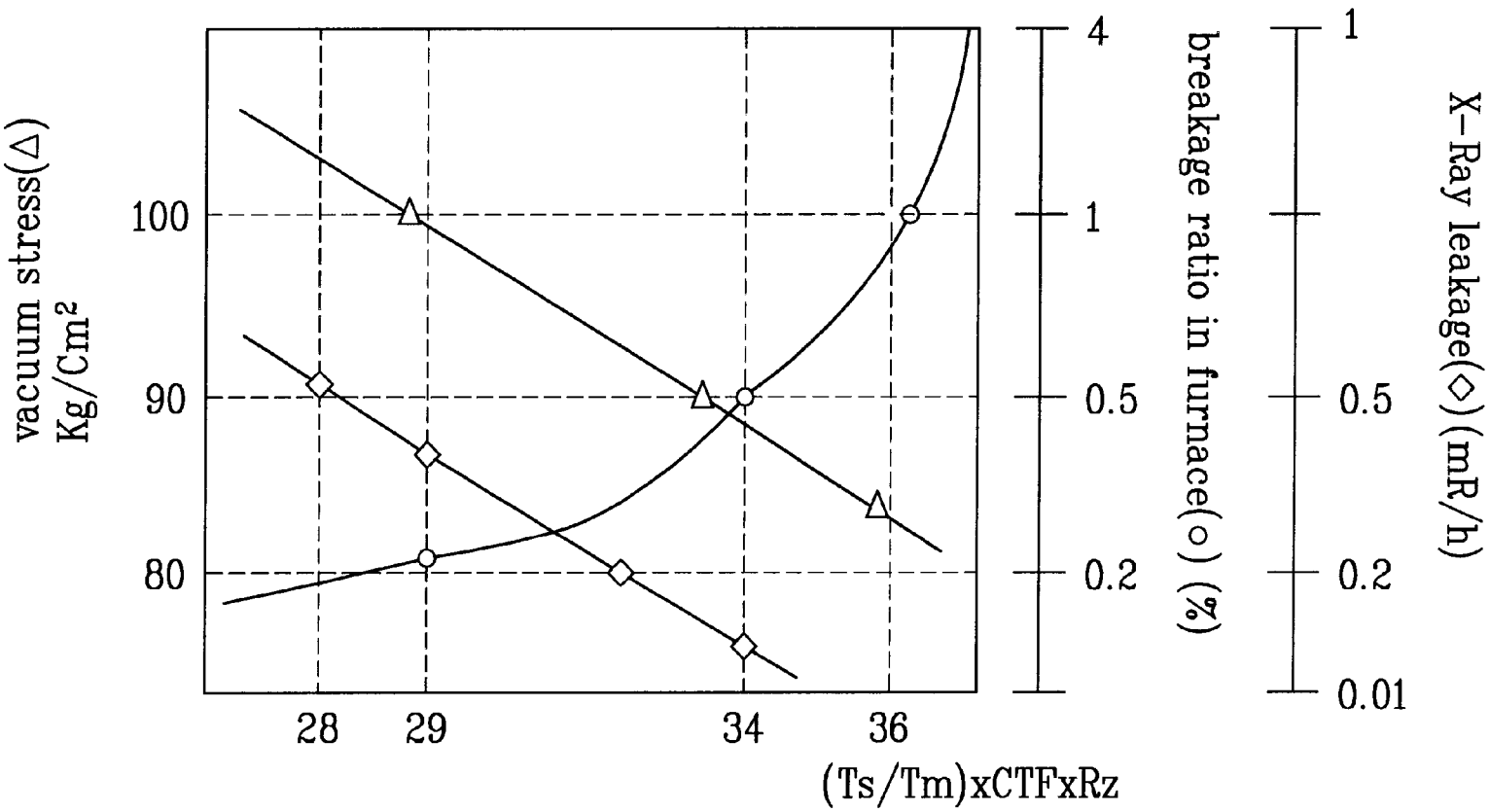

Referring to FIG. 6, a relation of the flat panel with (Ts/Tm)*CFT*Rz will be explained in detail. At first, a relation between the X-ray leakage and the (Ts/Tm)*CFT*Rz will be explained.

Once the CRT is put into operation, an electron beam is emitted from the electron gun, causing a certain amount of X-ray to leak through the panel of the CRT. Though slight, the X-ray leakage has an upper limit as a standard for safety. The X-ray leakage vary with an anode voltage, for an example, it is required that the X-ray leakage is below 0.5 mR/h at approx. 41 KV anode voltage.

As can be noted from FIG. 6, if the (Ts/Tm)*CFT*Rz is smaller 28 (when an absolute value of the CFT is 11.5 mm if the CRT is 29 inch size), the X-ray leakage is greater than 0.5 mR/h. Therefore, in view of the X-ray leakage, it is required that the (Ts/Tm)*CFT*Rz is greater than 28. It is preferable that the (Ts/Tm)*CFT*Rz is greater than 29 for being on a safe side.

Opposite to this, though the safety against X-ray is adequate, if the (Ts/Tm)*CFT*Rz is 36 (when an absolute value of the CFT is 13.5 mm if the CRT is 29 inch size), a reduction of weight from diagonal corners of the panel is no more than 0.7 Kg. That is, the effect is minimal in view of the panel weight reduction if the (Ts/Tm)*CFT*Rz is greater than 36. Therefore, it is preferable that the (Ts/Tm)*CFT*Rz is below 36.

In conclusion, it is preferable that the (Ts/Tm)*CFT*Rz is in a range of 28–36.

In the meantime, since the CRT is under a high vacuum, a vacuum stress is occurred at the panel 1 and the funnel 2. It is preferable that the vacuum stress does not exceed 100 Kg/cm$^2$ when a safety factor is taken to be 2.4. As can be noted in FIG. 6, when the (Ts/Tm)*CFT*Rz is 28, the vacuum stress slightly exceeds 100 Kg/cm$^2$. However, the vacuum stress can be reduced by 10% by the reinforcing band design depending on a size of the CRT. Therefore, if the (Ts/Tm)*CFT*Rz is greater than 28, it can be known that the CRT design is on the safe side in view of the vacuum stress, too. Moreover, it can be known that it is more preferable that the (Ts/Tm)*CFT*Rz is greater than 29 because the vacuum stress is perfectly below 100 Kg/cm$^2$ if the (Ts/Tm)*CFT*Rz is greater than 29.

Next, a relation of the breakage of panel during heat treatment with the (Ts/Tm)*CFT*Rz will be explained.

As explained, in view of the X-ray leakage and the vacuum strength, it is better to have a greater (Ts/Tm)*CFT*Rz. However, if the (Ts/Tm)*CFT*Rz is greater than a certain value, for an example, greater than 36, an absolute thickness variation at the corner is small in comparison to the related art CRT. According to this, if the (Ts/Tm)*CFT*Rz is greater than a certain value, the effect of the weight reduction is slight, and the effect of panel breakage prevention in the heat treatment is slight, too. Therefore, in this point of view, it is preferable that an upper value of the (Ts/Tm)*CFT*Rz is limited, appropriately.

The breakage ratio of the panel is very important in view of a production cost. Because even a slight reduction of the breakage ratio permits to achieve an enormous amount of production cost reduction as the CRT production is a process industry, with an annual output of one million units at the greatest, and a few hundred thousand units at the smallest. As shown in FIG. 6, if the (Ts/Tm)*CFT*Rz is below 34, the panel breakage ratio in the heat treatment is below 0.5%. Accordingly, for saving the production cost by reducing panel weight and the panel breakage ratio in the heat treatment, it is preferable that the (Ts/Tm)*CFT*Rz is below 34.

As explained, the flat CRT panel of the present invention can correct the panel breakage in the heat treatment, and the poor productivity, with a consequential high cost of the panel, which are problems of the related art CRT, by limiting the (Ts/Tm)*CFT*Rz to be within an appropriate range, and fixing optimal Ts, Tm, and CFT with reference to the (Ts/Tm)*CFT*Rz, thereby reducing the panel weight, and the absolute thickness of the panel corner.

The following table 1 compares panels of the related art and the present invention.

TABLE 1

| | | Related art panel | | Panel of the present invention | | | |
|---|---|---|---|---|---|---|---|
| | | 3* | 4* | 3* | | 4* | |
| 1* | 2* | RV* | RV* | UL* | LL* | UL* | LL* |
| 590 mm | 4:3 | 36.5 | 14.7 | 30 | 35 | 13.52 | 14.41 |
| 676 mm | 4:3 | 36.5 | 23.45 | 28 | 36 | 20.74 | 22.8 |
| 660 mm | 16:9 | 36.5 | 18.9 | 31 | 35 | 17.2 | 18.39 |
| 756 mm | 16:9 | 36.5 | 27.2 | 31 | 35 | 24.88 | 26.77 |

1*: Diagonal length of an effective screen,
2*: Aspect ratio,
3*: (Ts/Tm)*CFT*Rz,
4*: Weight (Kg),
RV*: Reference value,
UL*: Upper limit, and
LL*: Lower limit.

As can be known from table 1, the flat panel of the present invention has a total weight of the panel reduced by approx. 6%, and a diagonal corner thickness reduced by 4%–6% compared to the related art panel, while the requirements for the vacuum strength, and the allowable X-ray leakage are met.

Eventually, the flat panel of the present invention can reduce a panel production cost as an amount of glass used for production of the panel is reduced because the flat panel of the present invention can reduce weight of the panel for the same size of effective screen by adjusting the CFT of the panel. The thickness reduction at the panel diagonal corners permits a productivity improvement, that reduces the panel cost, too.

Also, the reduction of the CFT improves a luminance of the picture, thereby permitting improvement of the luminance without affecting a luminance uniformity.

Also, a total length of the CRT can be reduced as the CRT of the present invention has a shorter length relative to the related art flat CRT.

Moreover, an improvement of the thermal breakage (breakage during heat treatment) of the panel in a furnace, which is a major problem of the related art flat CRT, can be expected. Because the reduction of an absolute thickness at the corner causes to have a reduced latent heat, that prevents crack occurrence caused by a temperature difference between an inner and outer sides of the corner, which have occurred frequently at the corner.

It will be apparent to those skilled in the art that various modifications and variations can be made in the flat CRT panel of the present invention without departing from the spirit or scope of the invention. Thus, it is intended that the present invention cover the modifications and variations of this invention provided they come within the scope of the appended claims and their equivalents.

What is claimed is:

1. A flat cathode ray tube (CRT) panel comprising:

a substantially flat outside surface; and an inside surface with a certain radius of curvature, wherein the panel is formed such that (Ts/Tm)*CFT*Rz falls in a range of 28–36, where CFT denotes a center thickness, Ts denotes a diagonal effective screen edge thickness Ts, Tm denotes a maximum thickness at an interface of the skirt and the effective screen, and Rz denotes an inside radius of curvature, i.e., a value obtained by dividing the diagonal effective screen sectional radius of curvature Rd by the representative value {Rd/(1.767*a diagonal length of the effective screen)}.

2. The flat CRT panel as claimed in claim 1, wherein the panel is formed such that the (Ts/Tm)*CFT*Rz falls in the range of 29–34.

3. The flat CRT panel as claimed in claim 1, wherein the Rd denotes the sectional radius of curvature on the diagonal axis, the Ts denotes the effective screen edge thickness on the diagonal axis of the panel, and Tm denotes the maximum thickness at the interface of the panel skirt and the effective screen.

4. The flat CRT panel as claimed in claim 1, wherein the Rz has the value ranging from 2.7–3.2.

* * * * *